United States Patent [19]

Saiger

[11] 4,324,433

[45] Apr. 13, 1982

[54] KNOCKDOWN ARM CHAIR

[75] Inventor: Herbert C. Saiger, Troy, Ohio

[73] Assignee: Plantation Patterns, Inc., Birmingham, Ala.

[21] Appl. No.: 103,287

[22] Filed: Dec. 13, 1979

[51] Int. Cl.[3] ..... A47C 4/02

[52] U.S. Cl. ..... 297/442; 108/155; 248/188.7; 297/440; 297/443

[58] Field of Search ..... 297/440, 441, 442, 443, 297/444, 232; 248/150, 165, 432, 188.7; 108/153, 154, 155

[56] References Cited

U.S. PATENT DOCUMENTS

| | | | |
|---|---|---|---|
| 1,997,660 | 7/1934 | Smith | 108/154 X |
| 2,843,435 | 7/1958 | Hoven et al. | 108/154 X |
| 3,164,347 | 1/1965 | McMasters | 297/440 |
| 4,169,625 | 10/1979 | Peterson | 297/440 |

FOREIGN PATENT DOCUMENTS

| | | | |
|---|---|---|---|
| 1232409 | 4/1960 | France | 297/443 |
| 21123 | of 1910 | United Kingdom | 297/454 |

*Primary Examiner*—James T. McCall

*Attorney, Agent, or Firm*—Vogel, Dithmar, Stotland, Stratman & Levy

[57] ABSTRACT

A knockdown arm chair comprising a pair of double leg members each including two legs, two seat assembly supports and a connecting spacer all disposed in a generally common plane; the pair of double leg members interfit rigidly at right angles with the spacers in alignment to provide a rigid construction for a seat assembly including a seat, a back and a pair of arms pivoted at the free ends respectively to the sides of the seat and the back. Pins rigidly connect the rear of the seat to the back when the back is pivoted by the arms to the operative position, and spaced friction clips are provided at the bottom of the seat for engagement of adjacent seat assembly supports. The seat and the back are moveable into substantial alignment and the double leg members when separated may lie on the seat and back below the level of the arms, thereby minimizing space required for packaging and storage.

10 Claims, 9 Drawing Figures

FIG. 5
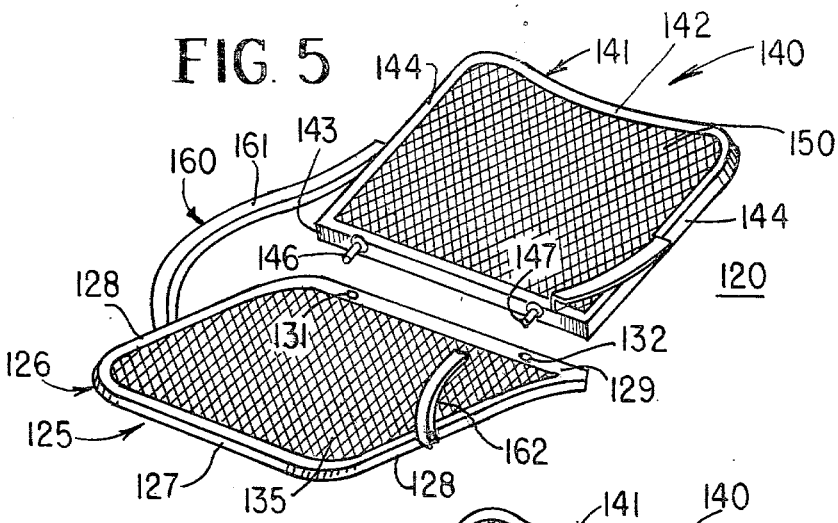
FIG. 6
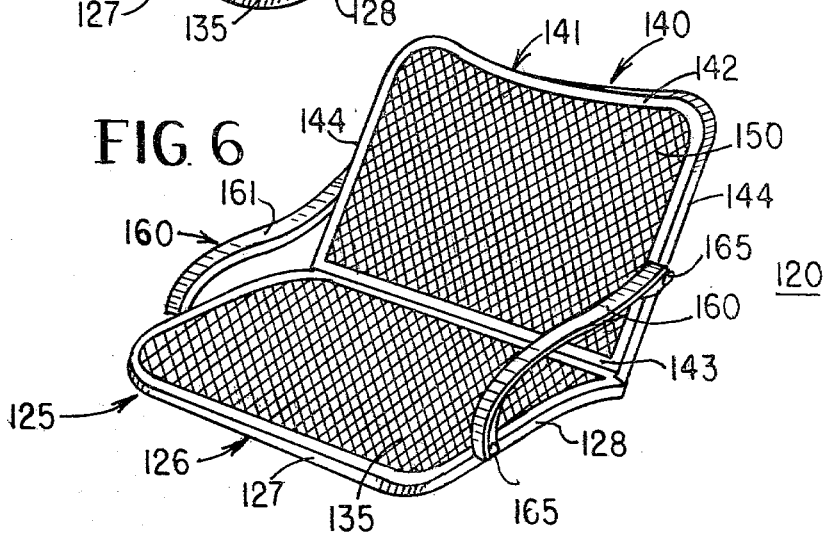
FIG. 8
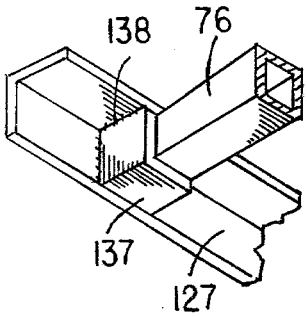
FIG. 7
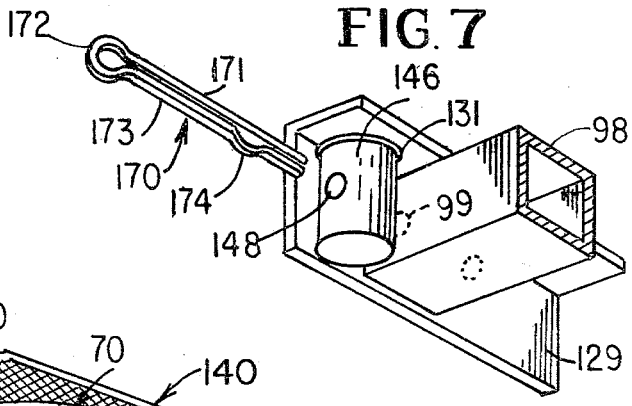
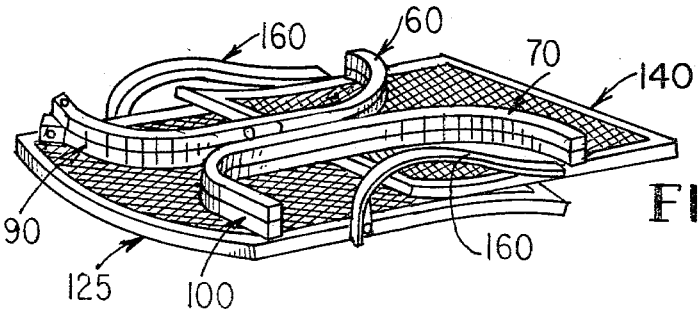
FIG. 9

KNOCKDOWN ARM CHAIR

BACKGROUND OF THE INVENTION

Because of the high cost of packaging and shipping materials, effort is constantly made to provide an improved method of packaging to minimize the size of the package required and, therefore, to minimize storage and shipping costs. The problem is especially prevalent with shipping objects such as chairs or tables where the ordinary shape of the chair in its assembled form occupies a relatively large space volume but the materials occupy only a small volume.

Efforts to provide folding chairs of the type which are moveable between an operative position for sitting and a compact storage position generally have resulted in chairs which are flimsy and do not provide a sturdy or solid construction. The compromises and/or trade offs between solid construction and small shipping volume have never been solved satisfactorily with the trade offs resulting inevitably in a solid construction with a large shipping volume or a small shipping volume and a relatively flimsy construction. Representative patents illustrating attempts to solve the above-discussed problems are those to Towns, U.S. Pat. No. 3,258,294 issued June 28, 1966 for Knockdown Chair and to Moxley, U.S. Pat. No. 3,057,661 issued Oct. 9, 1962 for Chair.

SUMMARY OF THE INVENTION

It is a principal object of the present invention to provide a knockdown chair which when assembled is rigid and sturdy and when knocked down or in the storage position provides a compact package for shipping.

Another object of the present invention is to provide a knockdown arm chair comprising a pair of double leg members each including two legs, two seat assembly supports and a connecting spacer all disposed in a generally common plane, the pair of double leg members adapted to interfit rigidly at right angles with the spacers in alignment; a seat assembly including a seat, a back and a pair of arms pivoted at the free ends respectively to the sides of the seat and the back; means rigidly connecting the rear of the seat to the back when the back is pivoted by the arms to the operative position; and spaced means at the bottom of the seat for attaching engagement of adjacent seat assembly supports of an interfitted pair of the double leg members; whereby the knockdown chair readily and rigidly assembled by the rigid connecting means, and when disassembled the seat and the back are moveable into the substantial alignment and the double leg members when separated may lie on the seat in back below the level of the arms, thereby minimizing space required for packaging and storage.

Another object of the present invention is to provide a knockdown arm chair of the type set forth in which the seat assembly includes a seat, a back and a pair of arms pivoted at the free ends respectively to the sides of the seat and back, the back having a pair of spaced studs adapted to extend through spaced openings at the rear of the seat when the back is pivoted by the arms to operative position, the seat at the front bottom having a pair of spaced means for attaching engagement of adjacent seat assembly supports of an interfitted pair of double leg members; and a pair of detachable means connecting the other two seat assembly seat supports to the studs at the rear of the seat when the back is in the operative position.

A still further object of the present invention is to provide a knockdown arm chair of the type set forth wherein each double leg member includes two generally U-shaped components with the spacers being ridigly secured to intermediate portions of the U-shaped components, the two spacers of each interfitting pair of double leg members displaced relative to each other such that the free end portions of the four U-shaped components lie in spaced parallel planes and the adjacent ends of the spacers are in proximity.

These and other objects of the present invention may more readily be understood when taken in conjunction with the accompanying specification in which:

BRIEF DESCRIPTION OF THE DRAWING

FIG. 5 is a perspective view of the seat assembly of the present invention in intermediate position thereof between the operative position and the storage position;

FIG. 6 is a perspective view of the seat assembly of the present invention in the operative position thereof;

FIG. 7 is an enlarged perspective view of one of the detachable connection means between the seat and the interfitted double leg members at the rear of the seat assembly;

FIG. 8 is an enlarged perspective view of one of the connection means between the seat assembly and the interfitted double leg members at the front of the seat assembly; and FIG. 9 is a perspective view of the seat assembly in the storage position thereof and the double leg members disassembled and positioned for packaging.

DETAILED DESCRIPTION OF THE INVENTION

Figure 1:
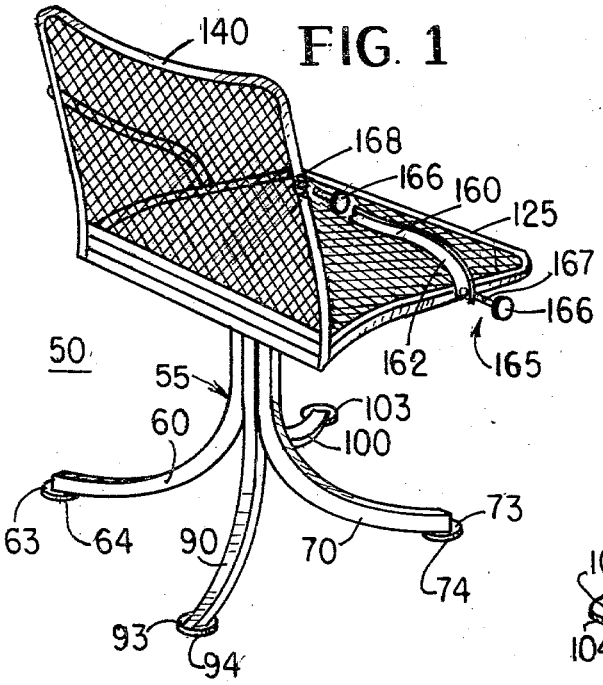
FIG. 1 is a rear perspective view of the knockdown arm chair of the present invention in the fully assembled condition thereof.
Figure 2:
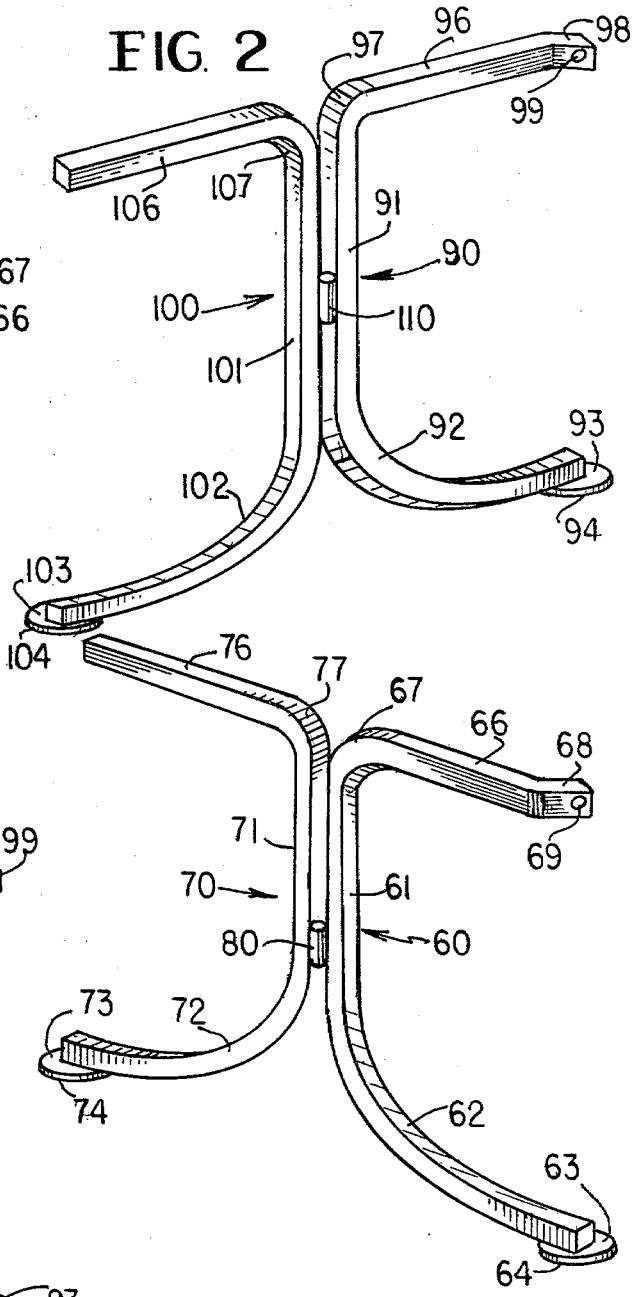
FIG. 2 is an exploded perspective view of a pair of double leg members aligned for interfitting.

Referring now to the drawings there is disclosed a chair 50 including a leg assembly 55 comprised of four leg members 60, 70, 90 and 100 with leg members 60 and 70 being interconnected by a cylindrical spacer 80 to form a double leg member and leg members 90 and 100 being interconnected by a cylindrical spacer 110 to form a double leg member, as will be explained. The leg-support member 60 as shown in tubular, square in transverse cross-section and includes a straight stem 61 which at one end thereof is integral with a gently curved portion 62 terminating in a foot 63 having a flat support surface 64. The other end of the straight stem 61, as shown, is integral with a straight seat assembly support portion 66 joined to the straight stem by a 90° elbow 67, the support portion 66 terminating in an angled connection portion 68 having an aperture 69 through opposed faces of the tubular member. The entire leg-support member 60 is generally U-shaped with the straight stem 61 forming the bight and with the seat support portion 66 and the curved leg portion 62 forming the legs.

Leg-support member 70 as shown is tubular, square in transverse cross-section and includes a straight stem 71 which at one end thereof is integral with a gently curved leg portion 72 terminating in a foot 73 having a flat support surface 74. The other end of the straight stem 71 is integral with a straight seat support portion 76 connected to the stem 71 by a 90° elbow portion 77. The leg-support member 60 and the leg-support member 70 are tubular and square in transverse cross-section, both having the same flat to flat dimensions. The leg-support members 60 and 70 are connected to each other and also maintained in predetermined spaced relation by means of the cylindrical spacer 80 welded as at 81 (FIG. 4) to the straight portions 61 and 71 of the members, respectively. Spacer 80 has a diameter substantially equal to the width dimension of tubular members 60 and 70.

The leg-support member 90 is tubular, square in transverse cross-section and includes a straight stem 91 which at one end thereof is integral with a gently curved portion 92 terminating in a foot 93 having a flat support surface 94. The other end of the straight stem 91 is integral with a straight seat assembly support portion 96 joined to the straight stem by a 90° elbow 97, the support portion 96 terminating in an angled connection portion 98 having an aperture 99 through opposed faces of the tubular member. The entire leg-support member 90 is generally U-shaped with the straight stem 91 forming the bight and with the seat support portion 96 and the curved leg portion 92 forming the legs.

Leg-support member 100 is tubular, square in transverse cross-section and includes a straight stem 101 which at one end thereof is integral with a gently curved leg portion 102 terminating in a foot 103 having a flat support surface 104. The other end of the straight stem 101 is integral with a straight seat support portion 106 connected to the stem 101 by a 90° elbow portion 107. The leg-support member 90 and the leg-support member 100 are tubular and square in transverse cross-section, both having the same flat to flat dimensions, and the same dimensions as leg-support members 60 and 70. The leg-support members 90 and 100 are connected to each other and also maintained in predetermined spaced relation by means of the cylindrical spacer 110 welded to the straight portions 91 and 101 of the leg-support members, respectively.

Figure 3:
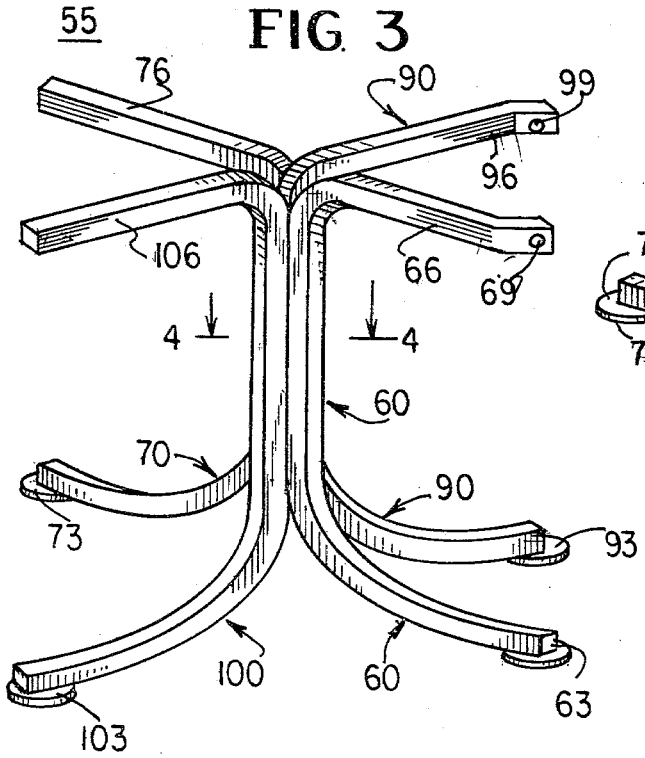
FIG. 3 is a perspective view of the leg members illustrated in FIG. 2 in the fully nested or interfitted condition thereof.
Figure 4:
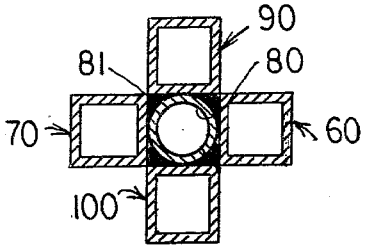
FIG. 4 is a section view of the interfitted leg members of FIG. 3 as viewed along lines 4—4 thereof.

The connected double leg members 60 and 70 interfit with the connected double leg members 90 and 100, as illustrated in FIGS. 3 and 4, such that the stem portions 61, 71, 91 and 101 of each leg-support member form a cruciform in transverse cross-section and the seat assembly supports 66, 76, 96 and 106 lie substantially in the same plane as do the flat bottom surfaces 64, 74, 94 and 104, the two planes being substantially parallel. The connecting cylindrical spacers 80 and 110 are displaced one with respect to the other so that the connected leg members 60 and 70 as well as the connected members 90 and 100 rigidly, frictionally interfit, as illustrated, with the cylindrical spacers 80 and 110 in abutment or close thereto but hidden from view due to the position of the stems 61, 71, 91 and 101 and due to the fact that the diameters of the spacers 80 and 110 are substantially the same as the flat to flat dimensions of the stems.

The seat assembly 120 includes a seat 125 defined by a generally rectangular seat frame 126, the members thereof preferably of metal and being of right angle cross-section. The seat frame 126 is sinuous along the sides 128 and relatively straight along the front 127 and the rear 129. Spaced apart apertures 131 and 132 are provided in the rear 129 of the seat frame 126 and spaced apart right angle trapping members 137 (FIG. 8) are fixedly connected or mounted to the front 129 of the seat frame 126 by means of the appropriate welds 138. Mesh material 135 or other desired material forms the sitting or support surface for the seat 125 and is suitably connected to the seat frame 126.

The seat assembly 120 further includes a back 140 defined by a generally rectangular back frame 141 preferably of metal and being of right angle cross-section. The back frame 141 includes a back frame top 142 and a spaced apart and substantially parallel back frame bottom 143 interconnected by the back frame sides 144. All the members 142, 143 and 144, as shown, are right angle in cross-section, and of the same dimensions as the seat frame 126. Spaced apart short cylindrical studs 146 and 147, each with an aperture 148 (FIG. 7), therethrough, depend from the back frame bottom 143 and have an outer diameter slightly smaller than the diameter of the apertures 131 and 132 in the seat frame 126 rear 129. A mesh or other desired material 150 is suitably connected to the back frame 141.

Two substantially identical sinuous arms 160 are provided each being right angle in transverse cross-section and having a support surface 161 and attachment surface 162. The arms 160 are pivotally mounted to both the seat 125 and the back 140 and more particularly to the seat frame 126 side members 128 and the back frame 141 side members 144. Specifically, the pivot connection means 165 each include a rivet 166 (FIG. 1) extending through the associated attachment surface 162 of the arm 160 and the associated frame member, either the back frame member 141 side 144 or the seat frame member 126 side 128. Each of the rivets 166 has an expanded end 167 and a washer 168 intermediate the associated arm and the associated seat or back frame member, 126 or 141 respectively. The washer 168 enables a suitable finish to be provided to the structural members and the expanded end 167 of the rivet 166 ensures that the pivoting connection between the arms 160 and the associated seat 125 and the back 140 remains secure.

Two detachable cotter pins 170 (one shown in FIG. 7) each having a flat base portion 171, and eyelet elbow portion 172 and an overlapping spring portion 173 having a raised portion 174 are provided to detachably connect the associated studs 146 and 147 after passing through apertures 131 and 132 on rear member 129 of seat frame 126 with the respective one of the angled portions 68 or 98 of the leg assembly 55 by passing through the apertures 69 or 99 and 148.

The cotter pins 170 serve to form a secure attachment such that the seat 125 and the back 140 are in fixed operative relation and rigidly connect to each other and to the leg assembly 55, thereby to provide the rigid and solid construction previously unattainable in prior art knockdown furniture. The rigid construction is further aided by the rigid friction of the leg-support members 60, 70, 90 and 100 forming the leg assembly 55 and the secure friction engagement of the leg portions 76 and 106 in the trapping members 137, thereby providing four securement points for the leg assembly 55 to the already rigid seat assembly 120.

Removal of the two cotter pins 170 permits disengagement of the studs 146 and 147 from the portions 68 and 98 of leg assembly 55 and pivoting movement of the seat assembly 120 with the seat 125 pivoting with respect to the back 140 at the four pivot points provided by the rivets 166 at the arms 160 and the associated sides 128 and 144, respectively of the seat 125 and the back 140, from the rigid operative position illustrated in FIG. 6 to the folded or storage position illustrated in FIG. 9. In the folded or storage position, the back 140 substantially overlies the seat 125 between the arms 160. The leg assembly 55 having been disassembled into two pair of two attached double leg members 60, 70, 90 and 100 fits intermediate the arms 160, and most importantly, the added two pair of double leg members stacked on the overlying seat 125 and the back 140 do not exceed the level of the arms 160 thereby to provide a compact unit for packaging, shipping and storage. The thickness of the package is defined by the level of the arms 160 and this compact package is far smaller than presently available knockdown arm chairs.

It is clear that various materials may be utilized for the leg assembly 55 and the seat assembly 120, with wrought iron or a synthetic organic resin being preferred. It is also clear that the principal objects of the present invention have been attained by providing, as described heretofore, a knockdown arm chair 50 which when assembled is entirely rigid and undiscernible from a permanently assembled chair, yet when disassembled to the knockdown condition is compact for shipping and storage.

While there has been described what a present is considered to be the preferred embodiment of the present invention, various modifications and alterations may be made therein without departing from the true spirit and scope of the present invention and it is intended to cover in the claims appended hereto all such modifications and alterations.

What is claimed is:

1. A knockdown arm chair, comprising: a pair of double leg members each including two legs, two seat assembly supports and a connecting spacer all disposed in a generally common plane, said pair of double leg members adapted to interfit rigidly at right angles with said spacers in alignment; a seat assembly including a seat, a back and a pair of arms pivoted at the free ends respectively to the sides of said seat and said back; detachable means rigidly connecting the rear of said seat to said back and to adjacent seat assembly supports when said back is pivoted by said arms to operative position; and spaced means at the bottom front of said seat for rigid attaching engagement of adjacent seat assembly supports of an interfitted pair of said double leg members; whereby said knockdown chair is readily and rigidly user-assembled by said rigid connecting means, and said seat and said back are movable into substantial alignment and said double leg members when separated may lie on said seat and back below the level of said arms thereby minimizing space required for packaging and storage.

2. The knockdown chair of claim 1 wherein said spacers are cylindrical members having the same outer diameter.

3. The knockdown chair of claim 1 wherein said pivoted arms provide movement of said seat and back between an operative position wherein the rear top of said seat abuts the bottom of said back and said seat and said back are rigidly connected one to the other end a storage position wherein said seat and said back overlap one another and are in substantially parallel planes.

4. The knockdown arm chair of claim 1 wherein a pair of said spaced means at the bottom of said seat are right angle brackets at the front of said seat bottom frictionally engaging the associated seat assembly supports.

5. A knockdown arm chair, comprising: a pair of double leg members each including two legs, two seat assembly supports and a connecting spacer all disposed in a generally common plane, said pair of double leg members adapted to interfit rigidly at right angles with said spacers in alignment; a seat assembly including a seat, a back and a pair of arms pivoted at the free ends respectively to the sides of said seat and said back, said back having a pair of spaced studs adapted to extend through spaced openings at the rear of said seat when said back is pivoted by said arms to operative position, said seat at the front bottom having a pair of spaced means for attaching engagement of adjacent seat assembly supports of an interfitted pair of said double leg members; and a pair of detachable means connecting the other two seat assembly supports to said studs at the rear bottom of said seat when said back is in operative position, whereby said knockdown arm chair is readily and rigidly assembled by said pair of detachable means, and said seat and said back are moveable into substantial alignment and said double leg members when separated may lie on said seat and back below the level of said arms, thereby minimizing space required for packaging and storage.

6. The knockdown arm chair of claim 5 wherein said seat and said back are edged by metallic members, said spaced openings at the rear of said seat extending through a metallic member, said pair of spaced means for attaching engagement of adjacent seat assembly support being mounted on a metallic member and said pair of arms being pivoted to metallic members of said seat and said back.

7. The knockdown arm chair of claim 5 wherein said arms are metallic members of right angle cross-section, and wherein rivets and intermediate washers establish the pivotal relationship between said arms and said seat and said back, said washers providing space for applying and preserving a finish at the pivot areas.

8. The knockdown arm chair of claim 5 wherein said detachable means connecting the other two seat assembly supports to said studs are pins extending through aligned openings in said studs and said supports, whereby a rigid relationship is established between said interfitted double leg members and said seat assembly.

9. The knockdown arm chair of claim 5 wherein each double leg member includes two generally U-shaped leg-support components, and said spacer is rigidly secured to intermediate portions of said U-shaped components, the two spacers of each interfitting pair of double leg members displaced relative to each other such that the free end portions of the four U-shaped components lie in spaced parallel planes and the adjacent ends of said spacers are in close proximity.

10. The knockdown arm chair of claim 9 wherein said U-shaped leg-support components are square in cross-section and wherein said connecting spacers are circular in cross-section and of diameter substantially equal to the width dimension of the cross-sectional square of said components, whereby said double leg members interfit rigidly and said spacers are substantially concealed from view.

* * * * *

UNITED STATES PATENT AND TRADEMARK OFFICE

CERTIFICATE OF CORRECTION

PATENT NO. : 4,324,433

DATED : April 13, 1982

INVENTOR(S) : Herbert C. Saiger

It is certified that error appears in the above-identified patent and that said Letters Patent are hereby corrected as shown below:

Column 5, line 65, "end" should be --and--.

Signed and Sealed this

Nineteenth Day of April 1983

[SEAL]

*Attest:*

GERALD J. MOSSINGHOFF

*Attesting Officer*

*Commissioner of Patents and Trademarks*